United States Patent [19]

Muller

[11] 4,377,955

[45] Mar. 29, 1983

[54] SCREW SPANNER OR WRENCH

[75] Inventor: Johann Muller, Much-Nesshoven, Fed. Rep. of Germany

[73] Assignee: Paul-Heinz Wagner, Much-Nesshoven, Fed. Rep. of Germany

[21] Appl. No.: 192,605

[22] Filed: Sep. 30, 1980

[30] Foreign Application Priority Data

Oct. 10, 1979 [DE] Fed. Rep. of Germany ..... 2941045

[51] Int. Cl.[3] ..... B25B 13/46

[52] U.S. Cl. ..... 81/57.39

[58] Field of Search ..... 81/53 R, 54, 57.39

[56] References Cited

U.S. PATENT DOCUMENTS

| | | | |
|---|---|---|---|
| 2,875,658 | 3/1959 | Benjamin | 81/53 R |
| 2,972,919 | 2/1961 | Stalkup | 81/53 R |
| 3,019,681 | 2/1962 | Grissom | 81/53 R |
| 3,447,404 | 6/1969 | Lachance | 81/57.39 |
| 3,557,644 | 1/1971 | Gregory | 81/57.39 |
| 3,616,714 | 11/1971 | Gregory | 81/57.39 |

*Primary Examiner*—James L. Jones, Jr.

*Attorney, Agent, or Firm*—Spensley, Horn, Jubas & Lubitz

[57] ABSTRACT

A wrench having a handle with an actuating lever arm pivoted for operation to rotate a nut engaging ring geometrically configured to accept a nut or bolt head. The nut engaging ring includes two tappets extending in the plane of rotation of the lever arm. A torque applied to the lever arm engages these tappets and thereby causes the nut engaging ring to rotate with increased force.

22 Claims, 9 Drawing Figures

Figure 1:
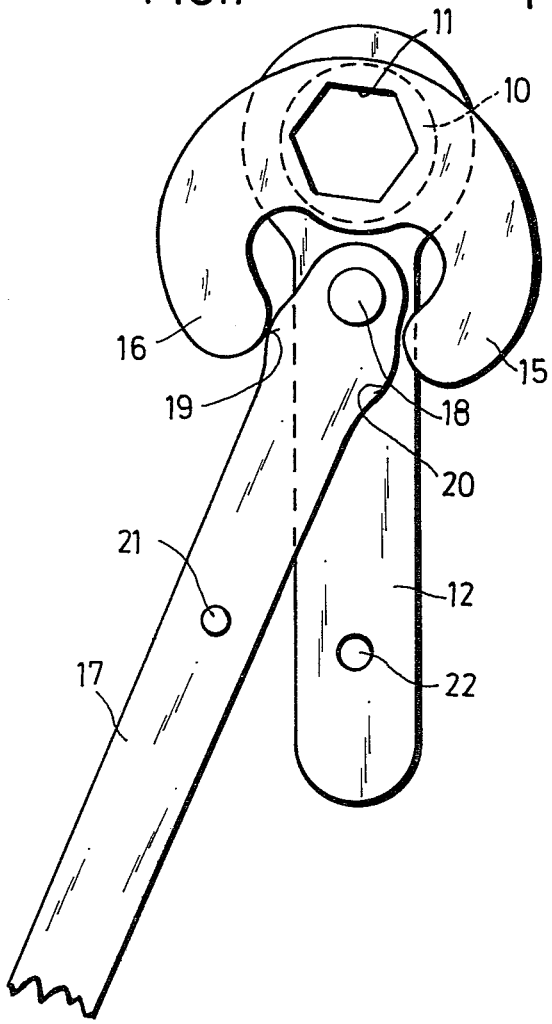

FIG. 3
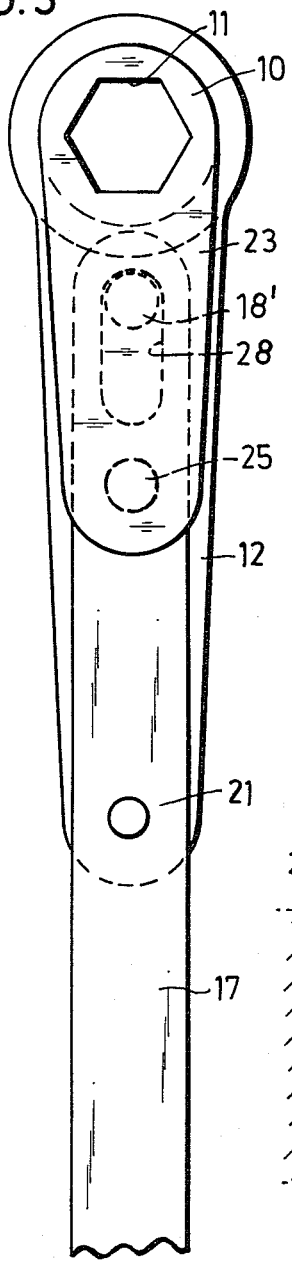
FIG. 4
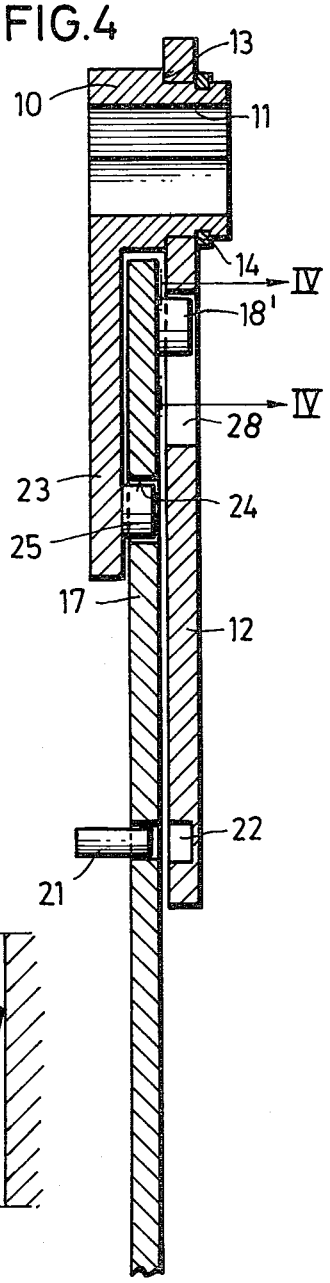
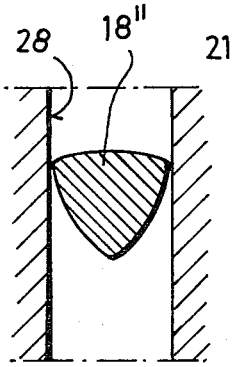
FIG. 4a

SCREW SPANNER OR WRENCH

The invention relates to a screw spanner comprising a ring rotatingly connectible integral with a key nut and a lever arm engaging the ring.

In the usual screw spanners the lever arm is firmly connected to the ring. The moment for tightening or unscrewing a screw is exerted manually or via a power drive on the lever arm which, as a result, is turning the ring. The ring may comprise an idle running system or a ratchet by which the key nut is entrained in one direction of rotation only, while the screw spanner can be returned idle in the other direction of rotation.

In the last phase of tightening or in the first phase of unscrewing a screw, a very high torque is required. To create this high torque, there have been known gear screw spanners in which a power amplification is realised by means of a gear. If the screw is unscrewed with the aid of the power amplification, the transmission ratio can be changed so that in the course of unscrewing the screw on the thread may be turned more quickly and with a low or no power amplification at all. Such gear screw spanners are very involved and expensive and, due to the gear, their weight is considerable.

It is the object of the invention to provide a screw spanner of the type mentioned at the outset hereof which can be used in the customary manner, by the direct action of the lever arm on the ring, as well as in connection with a power amplification to apply high torques.

To solve said problem, it is provided according to the invention that the ring is pivoted at a support leg and that the lever arm is hinged at the support leg to drive the ring via a power-amplifying transmission.

According to the invention, the lever arm is not firmly mounted at the ring, but it is pivoted at the support leg which may be applied to a stationary piece, e.g. to a screw adjacent to the one to be turned in order to carry off the reaction force caused with the power action on the lever arm. When rotated, the lever arm pivoted at the support leg at a distance from the ring axis drives the power-amplifying transmission which turns the ring accordingly. Thus, it is possible with simple means to apply the required high torque to the key nut or to the screw head.

If, on the other hand, the screw spanner is used in the usual manner, i.e. without the additional torque amplification, the lever arm may be mounted rotatingly integral with the support leg by an arresting device. A swing movement of the lever arm relative to the support leg not being possible any longer, the power-amplifying transmission is not possible any longer. In this condition, the lever arm and the support leg are acting like one sole unit on the ring so that the ring is rotated to the extent in which the lever arm is pivoted about the axis of the ring.

In an advantageous further embodiment of the invention the ring has at least one tappet projecting into the swing area of the lever arm about its pivot point at the support leg. When the lever arm is swivelled relative to the support leg, the lever arm presses against the tappet. The lever arm acts as a one-arm lever causing a power amplification. With a swivel of the lever arm about its pivot point, the angular rotation performed by the ring is inferior to that of the lever arm. In other words, the torque exerted on the ring is superior to the torque applied on the lever arm.

The tappet may be hinged with the lever arm, whereby the lever arm is supported via an oblong hole guidance at the oblong hole. The oblong hole guidance is necessary because the distance between the end of the lever arm and the axis of the ring changes in the course of the swivel movement of the lever arm. To reduce friction between the pin and the edge of the oblong hole as much as possible, the pin may be a freely rotatable roll.

In another embodiment of the invention, the tappet consists of an aperture in an extension laterally projecting from the ring and which is engaged by a pin projecting from the lever arm.

The tappet may also consist of at least one extension projecting from the ring and engaging laterally the lever arm either directly or via a roll.

According to an advantageous further embodiment of the invention, the ring has a first gear element at which rolls off with mutual intermeshing a second gear element supported at the support leg and firmly connected to the lever arm. In this case, power or torque amplification is achieved from the lever arm to the ring via a gear drive.

In the screw spanner, the ring can be so connected to the key nut that an entrainment of rotation is performed in both senses of rotation. However, it is also possible to cause the connection between ring and key nut to be integrally rotating in one sense of rotation only while in the other sense of rotation, the ring can be freely turned back with respect to the key nut. To this effect, an idle-running or ratchet system can be arranged between the ring and the key nut. A screw spanner, equipped with such a ratchet needs one sole tappet only if the power amplicifcation shall be performed in the one sense of rotation. To permit the backward rotation of the ring, it is suitably connected to the lever arm via a traction element which may be a joint plate which is hinged with the tappet and the lever arm accordingly. Alternatively, the traction element may be also a tackle line or the like.

To measure the screw moment, the screw spanner can be fitted with a usual torque measuring unit which is provided conveniently at the support leg.

Some embodiments of the invention will be now explained more closely hereinafter with reference to the Figures.

Figure 2:
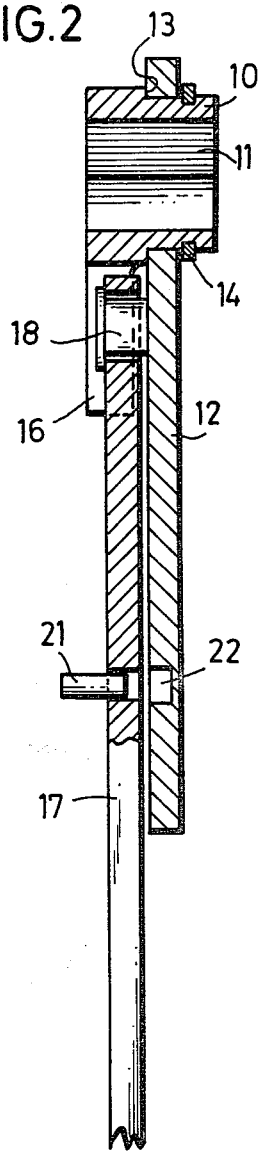
Figure 5:
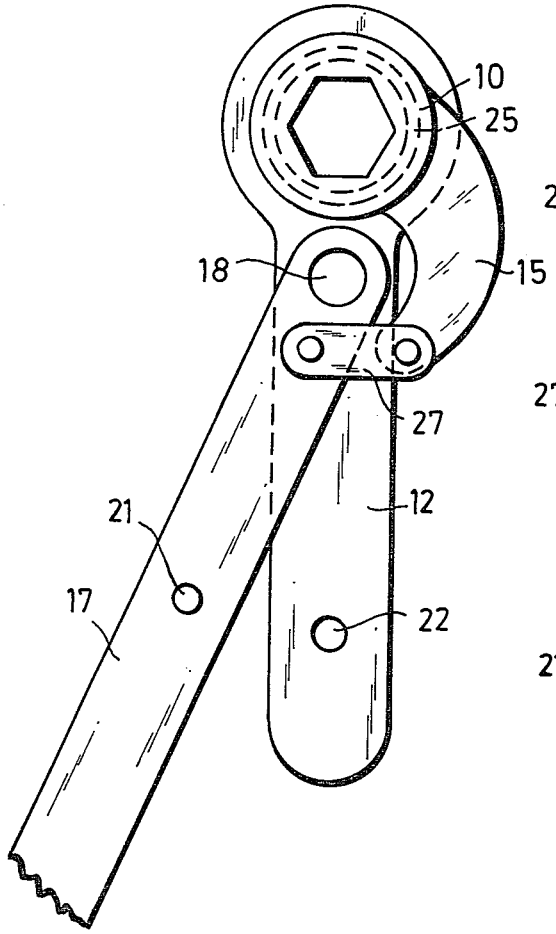
Figure 6:
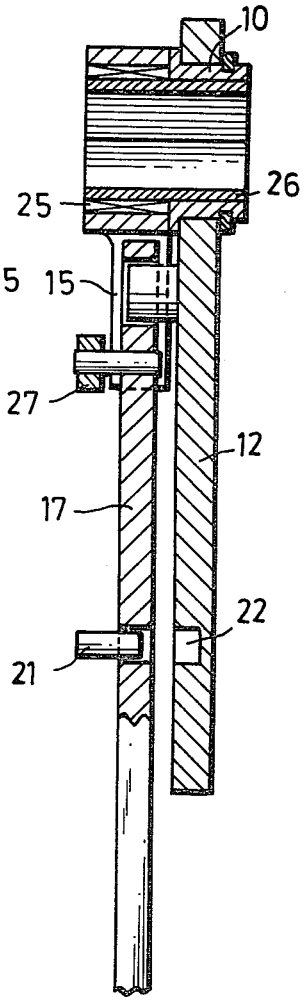
Figure 7:
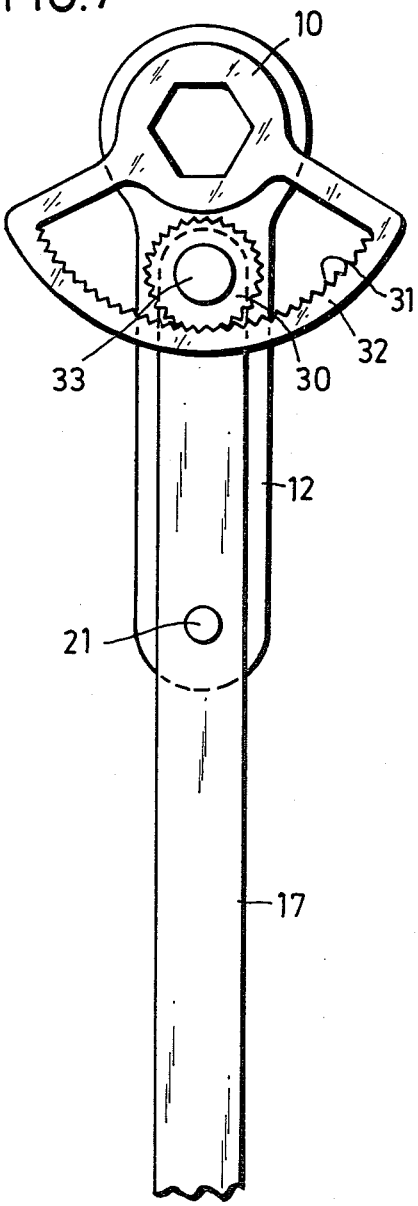
Figure 8:
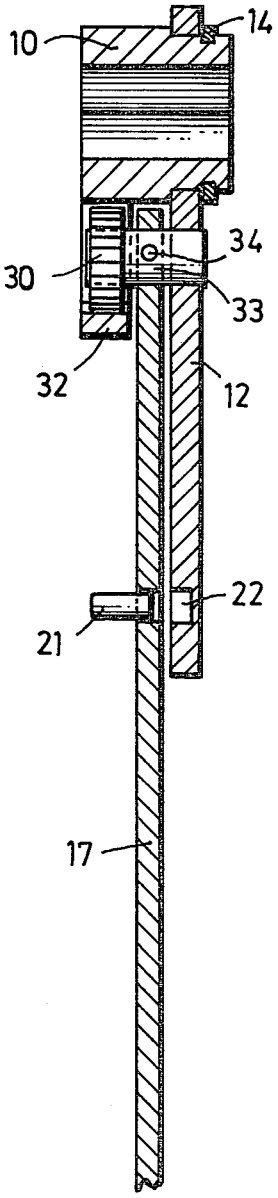

FIGS. 1 and 2 show a plan view and a longitudinal section of a first embodiment, FIGS. 3 and 4 show a plan view and a longitudinal section of a second embodiment, FIG. 4*a* is a section along line IV—IV of FIG. 4, FIGS. 5 and 6 are a plan view and a longitudinal section of a third embodiment and FIGS. 7 and 8 show a plan view and a longitudinal section of a fourth embodiment.

In the embodiment of FIGS. 1 and 2, the screw spanner comprises a ring 10 provided with a continuous hexagonal aperture 11 to insert a key nut. The ring 10 is pivoted in a bore of a support leg 12 consisting of a flat bar. Its cylindrical bearing surface is limited by a ring shoulder 13 and by a safety ring 14 disposed in an annular groove. Hence, ring 10 can be rotated in the aperture of the support leg 12.

In addition, above the plate-shaped support leg 12, the ring 10 is provided with extensions 15,16 which project like tongs from the main body of the ring 10. In the plane of extensions 15 and 16, there is a lever arm 17 which is supported at a pin 18 protruding from support leg 12. The lever arm 17 thus is swivable in parallel to the plane of the support leg 12 and in a plane extending vertically to the axis of the ring 10. The distance of the axis of pin 18 from the axis of ring 10 or the aperture 11 is inferior to the distance between the outer effective ends of the extensions 15 and 16 and the axis of ring 10 or the aperture 11. The lever arm 17 has substantially parallel edges provided with bulges 19,20 in that region of the lever arm 17 which cooperates with the effective ends of extensions 15 and 16.

The mode of operation of the screw spanner according FIGS. 1 and 2 is as follows:

If the screw head is rotated to untie the screw with a great torque anticlockwise, the support leg 12 is placed against a solid support with its side illustrated right-hand in FIG. 1. The lever arm 17 is rotated anticlockwise. As a result, the bulge 20 presses against the extension 15 of ring 10 thus exerting an anticlockwise torque on ring 10. Said torque, due to the distance of the pin 18 from the axis of ring 10 is considerably higher than the torque applied e.g. manually at lever arm 17.

If the screw is untied, and to facilitate further rotation, the lever arm 17 may be arrested with respect to the support leg 12. This may be realised for inst. by means of a pin 21 which is introduced transversely through the lever arm 17 and can be inserted into a recess 22 of the support leg 12, thus locking the lever arm 17 and the support leg 12 relative to each other. To permit rotating of the screw spanner in blocked condition, the support leg 12 must be removed, of course, from the (non-illustrated) stationary support. The hexagonal bore 11 being continuous, the key nut according to FIG. 2 may be inserted optionally from the right or left side into the hexagonal bore.

If the screw is to be tightened, the screw spanner will be basically used in the same manner, but the lever arm 17, with a released locking 21,22 is turned clockwise. To this effect, in the last phase of tightening, the bulge 19 is pressed against the extension 16 so that the torque is amplified also in this direction.

If the screw spanner is to be used as a ratchet spanner, a free- or idle running effect may be provided between the ring 10 and the (non-illustrated) key nut, to permit entrainment of the key nut only in one sense of rotation. In the screw spanner of FIGS. 3 and 4, only one sole tappet 23 is provided in place of the two tong-like extensions 15 and 16 of FIGS. 1 and 2 which enclose like a tong the front end of the lever arm, which tappet projects radially from ring 10 and covers the front end of the lever arm 17, which has an aperture 24. A pin 25 projecting from the tappet 17 extends into said aperture 24 to form a joint.

From the underside of the lever arm 17, a pin 18' protrudes into an oblong hole 28 of the support leg 12, which hole extends in longitudinal direction of the support leg 12. As evident from the Figures, the pin 25 has a greater distance from the axis of ring 10 than pin 18'.

If the right side of the support leg 12 is placed against a stationary abutment to unscrew a screw, and the lever arm 17 is turned anticlockwise, the pin 25 is swivelled about pin 18'. As a result, the tappet 23 is pivoted anticlockwise about the axis of ring 10 and ring 10 is rotated anticlockwise. The joint connection 24,25 between the tappet 23 and the lever arm 18 having a constant distance from the axis of ring 10, the distance of pin 18' from the axis of the ring 10 increases with the increasing swivel movement. Pin 18' thus migrates in the oblong hole 28 to the outside. By changing the effective lever arm length, the torque amplification rises with increasing swivel of the lever arm 17 from the rest position as shown in FIG. 3.

To be sure that the torque amplification is constant independently of the swing position of the lever arm 17, it is possible to use instead of a cylindrical pin 18' the non-circular pin 18'' as illustrated in FIG. 4*a*. The pin 18'' consists of a triangular roll body having spherical outer surfaces. During the swing movement of the lever arm 17, the contact point migrates between pin 18'' and the side wall of the oblong hole 28 to the outside.

By this means, by a corresponding shape of pin 18'' the amplification of the torque may be made independent from the swing position of the lever arm 17. Hence, it is possible to apply either at the lever arm 17 or at the support leg 12 a torque measuring device to measure the torque exerted on the screw through the applied power or the reaction force resp.

The embodiment of FIGS. 5 and 6 corresponds also to a far extent to the embodiment of FIGS. 1 and 2. However, the ring has only one sole extension 15 in the same plane as lever arm 17. This screw spanner is only effective in one sense of rotation accordingly. Between ring 10 and a sleeve 26 to insert the key nut, there is an idle running 25 permitting to turn back ring 10 in idle motion, while the sleeve 26 remains connected with the screw. If the rotation of the screw is anticlockwise according to FIG. 5, the ring 10 entrains via the free-running 25 the sleeve 26.

To permit to return idle the ring 10, the end of the extension 15 is connected to the lever arm 17 via a hinge member 27 which is a flap hinged at its one end at the end of extension 15 and at its other end, it engages flexibly the lever arm 17. If the lever arm 17 is turned back (clockwise), the hinge member 27 also draws back ring 10 via the extension 15. In this movement, the sleeve 26 does not rotate concomitantly. In place of the hinge member 27, another traction element could be also used.

In the embodiment of FIGS. 7 and 8, the power amplification is realised via a gear 30 connected rotatingly integral with the lever arm 12 and rolling on the inner teeth 31 of a tooth element 32 connected to ring 10. The tooth element 32 forms a circle about the axis of ring 10 and overlaps the front end of the lever arm 17.

The axle 33 of the gear 30 is pivoted in a bore of the support leg 12. The axle 33 protrudes through a bore at the front end of the support leg 12. With a cross section 34, it is mounted rotatingly in said bore integral with the lever arm 17. At the upper end of axle 33, the gear 30 is mounted rotatingly integral therewith.

If the lever arm 17 is swivelled about the axle 33, it rotates the gear 30 which, on its part, is turning the tooth element 32. Due to the different pitch diameters, a strong reduction of speed is taking place so that the rotation made by ring 10 is substantially inferior to the swivel movement made by the lever arm 17. Thus, the torque is amplified.

The gear 30 need not be provided with current teeth, because only part of the periphery of the gear is used.

What is claimed is:

1. A wrench for use with a geometrically configured nut or bolt head comprising:

a generally planar elongated support member, a ring member having a recess geometrically configured to receive said nut or bolt head, said ring member being pivotally mounted to said support member about a first pivot axis that is coaxial with said recess, and a lever arm pivotally attached to said support member about a second pivot axis that is parallel to but offset laterally from the first pivot axis by a first distance, said lever arm including at least one engagement means, said ring member having at least one extension integral therewith and extending in the plane of said lever arm to form an engagement surface for the engagement means on said lever arm, the distance between said first pivot axis and the point of engagement between said extension and said lever arm being greater than said first distance.

2. A wrench according to claim 1 wherein said ring member has two said extensions of equal length disposed on both sides of said lever arm to form two engagement surfaces for the engagement means on said lever arm.

3. A wrench according to claim 1 wherein said pivot axis for said lever arm further comprises:

a pin parallel to said pivot axis and rigidly attached to said lever arm, and an oblong guidance aperture within said support member for receiving said pin such that said pin may travel along the longitudinal access of said guidance aperture.

4. A wrench according to claim 1 wherein said engagement surface further comprises a rigid elongated hinge member, the first end of said hinge being pivotally attached to said lever arm and the second end of said hinge being pivotally attached to said extension.

5. A wrench according to claim 1 wherein said pivot axis for said lever arm further comprises:

a gear wheel rigidly attached to said lever arm, said gear wheel being coaxial with said pivot axis for said lever arm and coplanar with said extension, and a set of gear teeth disposed along at least one edge of said extension, said gear teeth intermeshing with said gear wheel.

6. A wrench for use with a geometrically configured nut or bolt head comprising:

a generally planar elongated support member, a ring member having a recess geometrically configured to receive said nut or bolt head, said ring member being pivotally connected to said support member at a first pivot point, the pivotal axis of such connection being coaxial with said recess, and a lever arm pivotally connected to said support member at a second pivot point, the pivotal axis of said second pivot being parallel to but offset laterally from the first pivot point;

said ring member having at least one extension integral therewith and extending in the plane of said lever arm to form a support point for said lever arm, wherein the distance between said support point and said first pivot point is greater than the distance between said second pivot point and said first pivot point, whereby a torque applied to said lever arm will cause said ring to rotate.

7. A wrench according to claim 6 wherein said ring includes at least one tappet extending in the plane of rotation of said lever arm.

8. A wrench according to claim 7 wherein said lever arm engages said at least one tappet so that a torque applied to said lever arm to rotate said ring will be amplified by said tappet.

9. A wrench according to claim 8 wherein said ring includes two of said tappets, each of which is disposed on opposite sides of the pivot point of said lever arm.

10. A wrench according to claim 6 wherein said ring member has two extensions of equal length disposed on both sides of said lever arm to form two points of contact with said lever arm.

11. A screw spanner according to claim 6 wherein said lever arm can be fixed relative to said support leg by a locking device.

12. A wrench according to claim 6 wherein said ring member includes one tappet containing a first pin extending parallel to said ring's axis of rotation and through an aperture in said lever arm at said second pivot point of said lever arm.

13. A wrench according to claim 12 wherein said lever arm includes a second pin extending parallel to said lever arm's axis of rotation and through an oblong guidance aperture extending longitudinally along said support leg such that a torque applied to said lever arm will cause said second pin to travel longitudinally along said guidance aperture.

14. A wrench according to claim 13 wherein any lateral cross-section of said second pin is a triangle, the sides of which triangle are outwardly convex.

15. A wrench according to claim 6 wherein said ring member includes a first tooth element in which a second tooth element supported in said support member and rigidly connected with said lever arm rolls with a mutual intermeshing.

16. A wrench according to claim 6 wherein said tappet is rotatably connected with said lever arm and said lever arm is supported via an oblong guidance hole.

17. A wrench according to claim 6 wherein said tappet includes a pin extending parallel to the axis of said ring member and engaging an aperture extending longitudinally along the lever arm.

18. A wrench according to claim 7 wherein said ring has a single tappet connected via a traction element with said lever arm.

19. A wrench according to claim 18 wherein said traction element is a joint plate connected flexibly between said tappet and said lever arm.

20. A wrench according to claim 17 wherein said pin consists of a spherical roll body which can be rotated and displaced in said guidance hole.

21. A wrench according to claim 7 wherein a torque applied to said lever arm is communicated to said tappet by a hinge, the first end of which is rotatably connected to said lever arm and the second end of which is rotatably connected to said tappet.

22. A wrench according to claim 7 wherein said tappet includes a row of gear teeth which intermesh with a gear wheel rigidly attached to said lever arm such that a torque applied to said lever arm causes said ring member to rotate.

* * * * *

UNITED STATES PATENT AND TRADEMARK OFFICE

CERTIFICATE OF CORRECTION

PATENT NO. : 4,377,955

DATED : March 29, 1983

INVENTOR(S) : Johann Muller

It is certified that error appears in the above-identified patent and that said Letters Patent are hereby corrected as shown below:

On The Title Page,

In address of assignee, change "Much-Nesshoven"

to --Much-Birrenbachshöhe--.

Signed and Sealed this

Second Day of August 1983

[SEAL]

Attest:

GERALD J. MOSSINGHOFF

Attesting Officer

Commissioner of Patents and Trademarks